US008251120B2

(12) United States Patent
Chen

(10) Patent No.: US 8,251,120 B2
(45) Date of Patent: Aug. 28, 2012

(54) CORDLESS BLIND STRUCTURE

(75) Inventor: Ju-Huai Chen, Changhua County (TW)

(73) Assignee: Chicology, Inc., Ontario, CA (US)

( * ) Notice: Subject to any disclaimer, the term of this patent is extended or adjusted under 35 U.S.C. 154(b) by 68 days.

(21) Appl. No.: 12/878,694

(22) Filed: Sep. 9, 2010

(65) Prior Publication Data

US 2012/0061037 A1 Mar. 15, 2012

(51) Int. Cl.
*A47G 5/02* (2006.01)

(52) U.S. Cl. ..... 160/314; 160/323.1

(58) Field of Classification Search ..... 160/314, 160/323.1, 238, 313
See application file for complete search history.

(56) References Cited

U.S. PATENT DOCUMENTS

| | | | | | |
|---|---|---|---|---|---|
| 324,135 | A | * | 8/1885 | Malmstrom | 160/314 |
| 330,579 | A | * | 11/1885 | Grimm | 160/303 |
| 1,028,995 | A | * | 6/1912 | Czabor | 160/303 |
| 1,085,417 | A | * | 1/1914 | Harrison | 160/301 |
| 1,144,030 | A | * | 6/1915 | Drumm | 160/303 |
| 1,219,100 | A | * | 3/1917 | Heyslett | 160/303 |
| 1,228,303 | A | * | 5/1917 | Drumm | 160/314 |
| 1,300,778 | A | * | 4/1919 | Revier | 160/303 |
| 1,500,585 | A | * | 7/1924 | Hayslett | 160/301 |
| 1,567,095 | A | * | 12/1925 | Anderson | 160/301 |
| 1,568,379 | A | * | 1/1926 | Hartley | 160/299 |
| 1,865,466 | A | * | 7/1932 | Gossling et al. | 160/303 |
| 2,517,270 | A | * | 8/1950 | Zimmerman | 160/72 |
| 2,868,285 | A | * | 1/1959 | Pidgeon | 160/323.1 |
| 5,787,952 | A | * | 8/1998 | Wegner | 160/100 |

* cited by examiner

*Primary Examiner* — David Purol

(74) *Attorney, Agent, or Firm* — Apex Juris, pllc; Tracy M. Heims

(57) ABSTRACT

The present invention relates to a cordless blind structure including a blind body further comprising a batten and a shade having an end disposed at an outer edge of the batten; a first end holder movably disposed at a first end of the batten; a second end holder movably disposed at a second end of the batten; and a limiting mechanism disposed between the blind body and the second end holder, the limiting mechanism including a resilient unit and an axial unit, the resilient unit being movably disposed at the second end holder, and the axial unit being movably disposed at the second end holder, controllably coupled to the resilient unit, and coupled to the second end of the batten. The shade is lifted or lowered by exerting a force thereon in conjunction with the limiting mechanism so as to ensure ease of use and enhance user safety.

5 Claims, 5 Drawing Sheets

CORDLESS BLIND STRUCTURE

FIELD OF THE INVENTION

The present invention relates to cordless blind structures, and more particularly, to a cordless blind structure with a limiting mechanism and a shade configured to be lifted or lowered by exerting a force on the shade operating in conjunction with the limiting mechanism so as to ensure ease of use and enhance user safety.

BACKGROUND OF THE INVENTION

A conventional blind (such as a Roman blind) comprises an upper beam, an elevating unit, and a shade coupled to the bottom of the upper beam. The elevating unit has a plurality of tractional cords and lifting cords. The shade comprises a plurality of slats. At least a plurality of holes are formed in each of the slats. The holes are lined up and penetrated by the lifting cords in a manner that the lifting cords are fixed to the lowest ones of the holes, respectively. To lift or lower the shade, a user pulls the tractional cords to thereby lift or lower the shade with the lifting cords.

The conventional blind has a drawback. The tractional cords are always found on one side of the shade. Toddlers are likely to put the tractional cords on their necks out of curiosity or during an inadvertent act committed in play. With a tractional cord on the neck, a toddler may end up in strangulation. Hence, tractional cords of the conventional blind pose a serious threat to child safety.

Accordingly, it is imperative to provide a cordless blind structure that features ease of use and enhanced user safety.

SUMMARY OF THE INVENTION

In view of the aforesaid drawback of the conventional blind, the inventor of the present invention believes that the conventional blind has room for improvement. Thus, the inventor of the present invention endeavors to improve the conventional blind from the inventor's experience of the related industry. Eventually, the inventor puts forth a cordless blind structure that features ease of use and enhanced user safety.

It is a primary objective of the present invention to provide a cordless blind structure with a limiting mechanism and a shade configured to be lifted or lowered by exerting a force on the shade operating in conjunction with the limiting mechanism so as to ensure ease of use and enhance user safety.

In order to achieve the above and other objectives, the present invention provides a cordless blind structure comprising: a blind body further comprising a batten and a shade having an end disposed at an outer edge of the batten; a first end holder movably disposed at a first end of the batten; a second end holder movably disposed at a second end of the batten; and a limiting mechanism disposed between the blind body and the second end holder, the limiting mechanism comprising a resilient unit and an axial unit, the resilient unit being movably disposed at the second end holder, and the axial unit being movably disposed at the second end holder, controllably coupled to the resilient unit, and coupled to the second end of the batten.

In an embodiment of the present invention, a weight member is disposed at another end of the shade, and a tractional member is disposed at the weight member.

In an embodiment of the present invention, the first end holder has a hole, and a retractable axle is disposed at the first end of the batten and configured to correspond in position to the hole.

In an embodiment of the present invention, the second end holder is provided with at least two posts so as for the resilient unit and the axial unit to be disposed on the at least two posts, respectively, and the second end holder is provided with a cover thereon so as for the limiting mechanism therebetween to be hermetically sealed.

In an embodiment of the present invention, the resilient unit further comprises a constant-force spring and baffles flanking the constant-force spring, the constant-force spring having an end disposed at the second end holder and another end coupled to the axial unit.

In an embodiment of the present invention, the axial unit further comprises a roller controllably coupled to the resilient unit, an axle member coupled to the roller, and a linking member coupled to the axle member and the second end of the batten.

Accordingly, the present invention provides a cordless blind structure with a limiting mechanism and a shade configured to be lifted or lowered by exerting a force on the shade operating in conjunction with the limiting mechanism so as to ensure ease of use and enhance user safety.

BRIEF DESCRIPTION OF THE DRAWINGS

To enable persons skilled in the art to gain insight into the objectives, features and advantages of the present invention, the present invention is hereunder illustrated with specific embodiments in conjunction with the accompanying drawings, in which.

DETAILED DESCRIPTION OF THE PREFERRED EMBODIMENTS

Figure 1:
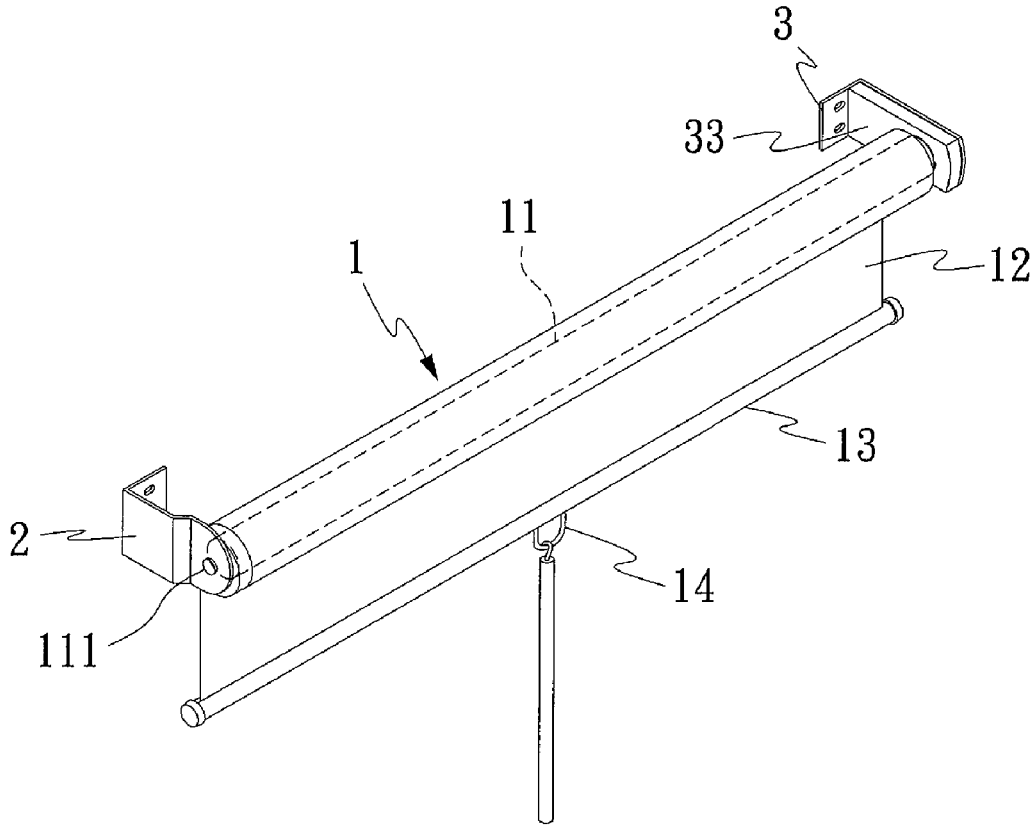
FIG. 1 is a perspective view of a cordless blind structure of the present invention.
Figure 2:
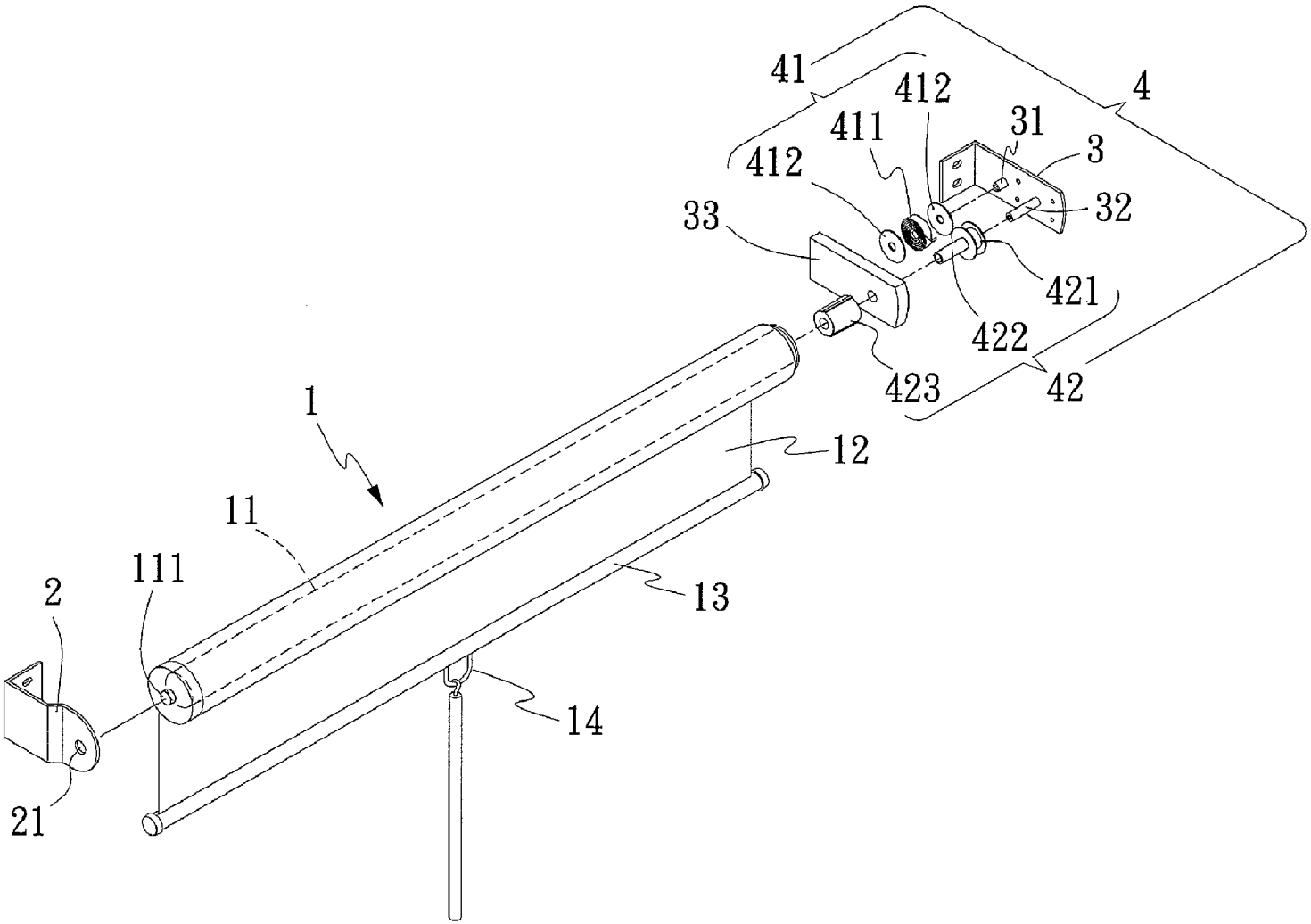
FIG. 2 is an exploded view of the cordless blind structure of the present invention.

Referring to FIG. 1 and FIG. 2, there are shown a perspective view and an exploded view of a cordless blind structure of the present invention, respectively. As shown in the drawings, a cordless blind structure of the present invention comprises a blind body 1, a first end holder 2, a second end holder 3, and a limiting mechanism 4.

The blind body 1 comprises: a batten 11, a shade 12 having an end disposed at the outer edge of the batten 11, a weight member 13 disposed at another end of the shade 12, and a tractional member 14 disposed at the weight member 13, wherein a retractable axle 111 is disposed at a first end of the batten 11.

The first end holder 2 is movably disposed at the first end of the batten 11. A hole 21 is formed in the first end holder 2. The retractable axle 111, which is disposed at the first end of the batten 11, corresponds in position to the hole 21. Hence, the retractable axle 111 enables the batten 11 to be mounted on and unmounted from the first end holder 2.

The second end holder 3 is movably disposed at a second end of the batten 11. The second end holder 3 is provided with at least two posts 31, 32 thereon and a cover 33.

The limiting mechanism 4 is disposed between the blind body 1 and the second end holder 3. To be specific, the limiting mechanism 4 is disposed mostly between the second end holder 3 and the cover 33, so as to be hermetically sealed. The limiting mechanism 4 comprises a resilient unit 41 and an axial unit 42. The resilient unit 41 and the axial unit 42 are disposed on the at least two posts 31, 32, respectively. The resilient unit 41 is movably disposed at the second end holder 3. The axial unit 42 is movably disposed at the second end holder 3, connected to the resilient unit 41, and coupled to the second end of the batten 11. The resilient unit 41 comprises a constant-force spring 411 and baffles 412 flanking the constant-force spring 411. The constant-force spring 411 is disposed on the post 31 of the second end holder 3 and thus held between the second end holder 3 and the cover 33. The axial unit 42 comprises a roller 421, an axle member 422, and a linking member 423. The roller 421 is controllably coupled to the constant-force spring 411 and disposed on the post 32 of the second end holder 3. The axle member 422 is coupled to the roller 421. The linking member 423 is coupled to, and between, the axle member 422 and the second end of the batten 11.

Figure 3:
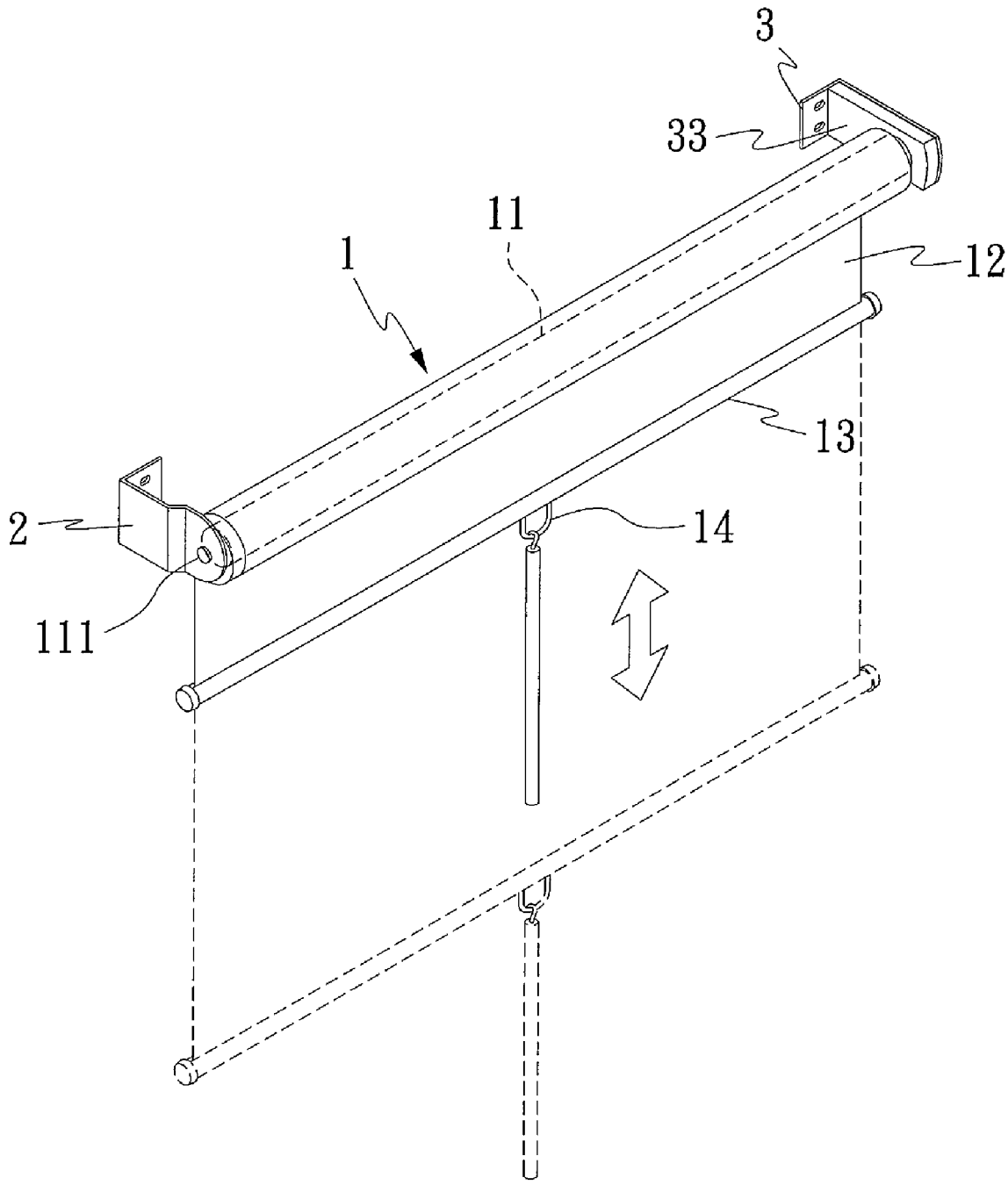
FIG. 3 is a perspective view of the cordless blind structure in use according to the present invention.
Figure 4:
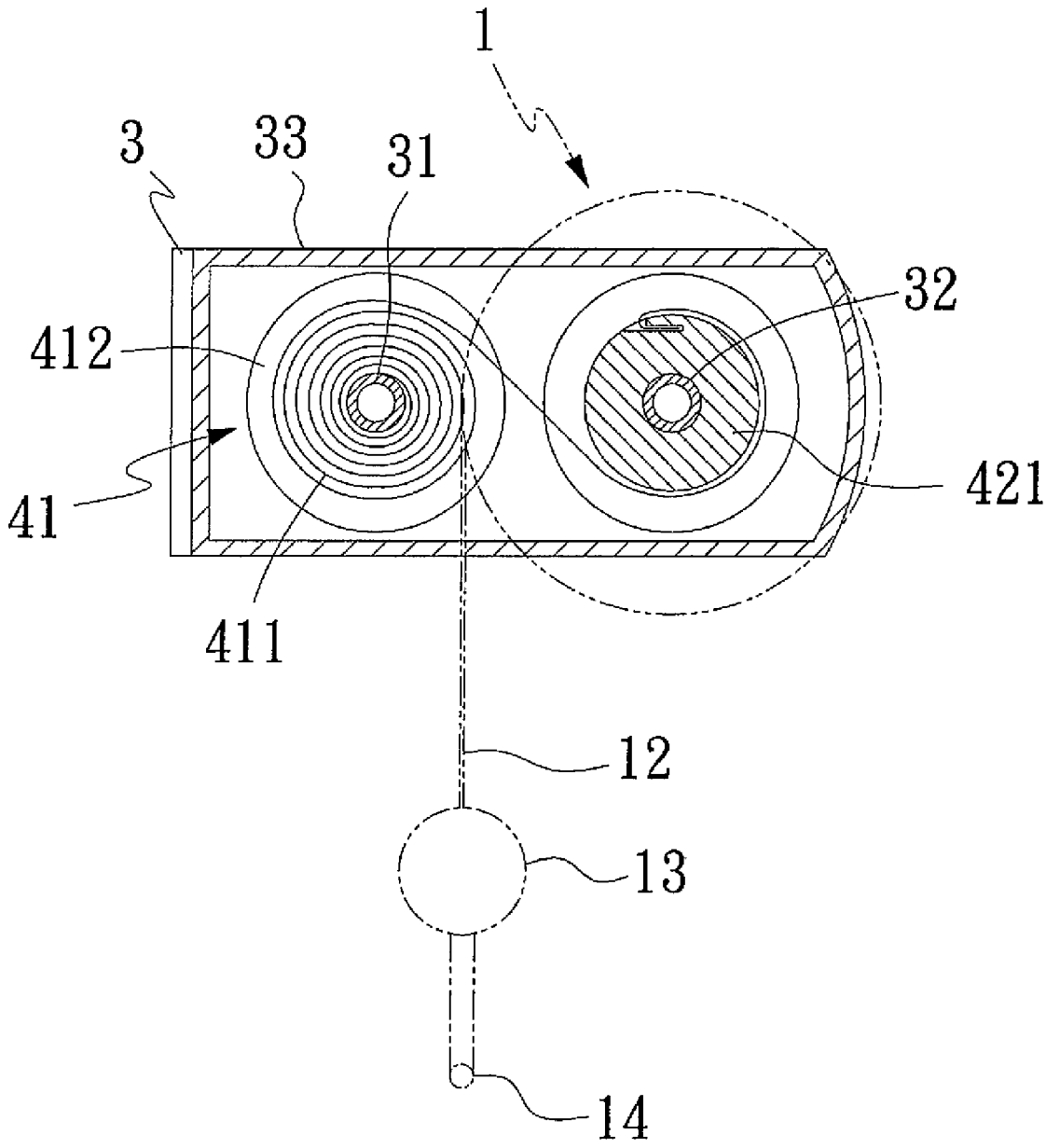
FIG. 4 is a schematic view of a batten for driving a limiting mechanism according to the present invention.
Figure 5:
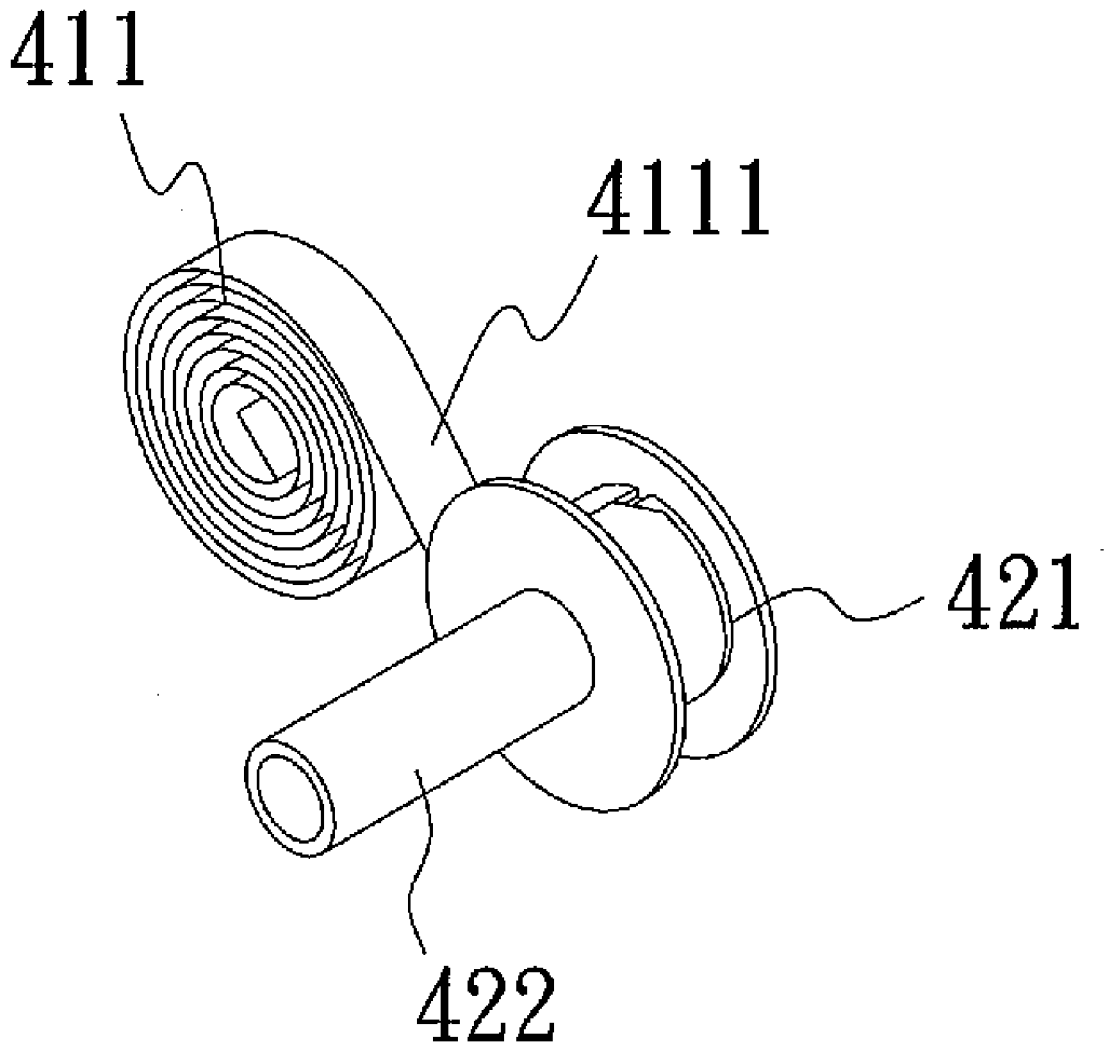
FIG. 5 is a perspective view of a spring-steel ribbon of a constant-force spring of the cordless blind structure in use according to the present invention.

Referring to FIG. 3 through FIG. 5, there are shown a perspective view of the cordless blind structure in use according to the present invention, a schematic view of the batten 11 for driving the limiting mechanism 4 according to the present invention, and a perspective view of a spring-steel ribbon 4111 of the constant-force spring 411 according to the present invention. As shown in the drawings (and FIGS. 1 and 2 as well), installation of the cordless blind structure of the present invention entails fixing the first end holder 2 and the second end holder 3 to the top of a window frame. To use the cordless blind structure of the present invention, a user applies an external force to the weight member 13 or the tractional member 14 so as to lift or lower the shade 12. The lifting or lowering of the shade 12 drives the batten 11 to rotate. The batten 11 is held between the first and second end holders 2, 3 by the retractable axle 111 and the linking member 423 of the axial unit 42, respectively, while the batten 11 is rotating under the lifting or lowering force driven by the shade 12 being lifted or lowered; meanwhile, the axle member 422, which is coupled to the second end of the batten 11 through the linking member 423, drives the roller 421 to rotate. Rotation of the roller 421 causes the spring-steel ribbon 4111 of the constant-force spring 411 to be reeled out or in. Once the external force applied to the shade 12 stops, the position of the shade 12 can be limited by the constant-force spring 411, the roller 421, and the torque generated therefrom and conveyed by the spring-steel ribbon 4111. Furthermore, the position of the shade 12 is limited by the aforesaid means so as for the shade 12 to stay stationary at the last position thereof. In so doing, the present invention dispenses with a cord usually required for driving the shade 12. Accordingly, the cordless blind structure of the present invention is advantageously characterized by ease of use and enhanced user safety.

Hence, the present invention meets the three requirements of patentability, namely novelty, non-obviousness, and industrial applicability. Regarding novelty and non-obviousness, the present invention discloses applying an external force to a shade to lift or lower the shade and enable the shade to operate in conjunction with a limiting mechanism with a view to ensuring ease of use and enhancing user safety. Regarding industrial applicability, products derived from the present invention meet market demands fully.

The foregoing preferred embodiments are provided to illustrate and disclose the technical features of the present invention, and are not intended to be restrictive of the scope of the present invention. Hence, all equivalent modifications and replacement of the foregoing embodiments without departing from the spirit embodied in the disclosure of the present invention should fall within the scope of the present invention as set forth in the appended claims.

What is claimed is:

1. A cordless blind structure, comprising:

a blind body further comprising a batten and a shade having an end disposed at an outer edge of the batten;

a first end holder movably disposed at a first end of the batten;

a second end holder movably disposed at a second end of the batten;

a limiting mechanism disposed between the blind body and the second end holder, the limiting mechanism comprising a resilient unit and an axial unit, the resilient unit being movably disposed at the second end holder, and the axial unit being movably disposed at the second end holder, controllably coupled to the resilient unit, and coupled to the second end of the batten; and wherein the resilient unit further comprises a constant-force spring and baffles flanking the constant-force spring, the constant-force spring having an end disposed at the second end holder and another end coupled to the axial unit.

2. The cordless blind structure of claim 1, wherein a weight member is disposed at another end of the shade, and a tractional member is disposed at the weight member.

3. The cordless blind structure of claim 1, wherein the first end holder has a hole, and a retractable axle is disposed at the first end of the batten and configured to correspond in position to the hole.

4. The cordless blind structure of claim 1, wherein the second end holder is provided with at least two posts so as for the resilient unit and the axial unit to be disposed on the at least two posts, respectively, and the second end holder is provided with a cover thereon so as for the limiting mechanism therebetween to be hermetically sealed.

5. The cordless blind structure of claim 1, wherein the axial unit further comprises a roller controllably coupled to the resilient unit, an axle member coupled to the roller, and a linking member coupled to the axle member and the second end of the batten.

* * * * *